US007470841B1

(12) United States Patent
McCabe

(10) Patent No.: US 7,470,841 B1
(45) Date of Patent: Dec. 30, 2008

(54) TUNING APPARATUS FOR STRINGED INSTRUMENT

(76) Inventor: Geoffrey L McCabe, 19995 Sischo Dr., Topoganga, CA (US) 90290

( * ) Notice: Subject to any disclaimer, the term of this patent is extended or adjusted under 35 U.S.C. 154(b) by 0 days.

(21) Appl. No.: 09/830,279

(22) PCT Filed: Sep. 29, 1998

(86) PCT No.: PCT/US98/20376

§ 371 (c)(1),
(2), (4) Date: Oct. 23, 2001

(87) PCT Pub. No.: WO00/19405

PCT Pub. Date: Apr. 6, 2000

(51) Int. Cl.
*G10D 13/02* (2006.01)

(52) U.S. Cl. ..... 84/312 R

(58) Field of Classification Search ..... 84/312 R, 84/313, 314, 314 R, 314 N, 298–302, 307
See application file for complete search history.

(56) References Cited

U.S. PATENT DOCUMENTS 4,261,240 A * 4/1981 Aaroe ..... 84/726
4,506,585 A * 3/1985 Desmond ..... 84/298
4,655,116 A * 4/1987 Matsui ..... 84/297 R
4,742,750 A * 5/1988 Storey ..... 84/267
4,763,555 A * 8/1988 Minakuchi et al. ..... 84/313
4,768,415 A * 9/1988 Gressett et al. ..... 84/298
5,381,716 A * 1/1995 May et al. ..... 384/4
5,438,902 A * 8/1995 Baker ..... 84/312 R
5,965,831 A * 10/1999 McCabe ..... 84/313
5,986,190 A * 11/1999 Wolff et al. ..... 84/297 R
5,986,191 A * 11/1999 McCabe ..... 84/313
6,563,034 B2 * 5/2003 McCabe ..... 84/312 R

* cited by examiner

*Primary Examiner*—Kimberly R Lockett

(57) ABSTRACT

A stringed musical instrument is provided with a tremolo with a unitary base plate formed from a single folded or bent plate including a spring attachment means portion so that the tremolo is connected directly to the biasing springs; such a folded construction also includes multiple tiers stamped into the base plate portion for displacing the height of the second critical point on the intonation modules relative to the body of the instrument; the spring attachment means portion is fashioned such that the openings for anchoring the ends of the strings are aligned to openings in the base plate for threading the strings through the intonation modules. Additionally, intonation modules include alternative means for anchoring the strings located a critical distance from the second critical point essentially equal to the length of the anchoring portion or the reinforcement windings of the strings but not sufficient in length to engage the second critical point so as to render that portion of the string between the second critical point and the string anchor substantially inextensible.

31 Claims, 5 Drawing Sheets

TUNING APPARATUS FOR STRINGED INSTRUMENT

BACKGROUND OF THE INVENTION

In a stringed musical instrument, such as a guitar, the strings extend unsupported between a first critical point usually formed by the nut where the neck joins the head and a second critical point usually formed by the bridge positioned on the body. The strings are anchored at one end on a portion of the instrument known as the tailpiece, strung over the bridge and the nut on the head of the instrument and in conventional instruments anchored on the other end to the tuning pegs where an untensioned string is tensioned and adjusted to a tuned condition. The second critical point is formed by a part of the bridge or by a part of a combined bridge and tailpiece structure. Traditionally, the size of the bridge elements are quite small so as to create a clearly defined single point of contact between the string and the bridge element. It is between these two points that the string length is determined. This is sometimes referred to as the scale length. Adjusting the relative distance between the first and second critical points is called harmonic tuning. Some bridge structures have individually adjustable bridge elements for each string. Often the typical construction of the strings, particularly for guitar and bass, have a plain end and a "ball end" in which a washer-like addition is wrapped by the string itself as a means to help in securing the string to the instrument on the tailpiece. The wrapping is typically thicker than the rest of the string so that the wrapping is substantially inextensible. The wrapping usually extends for at least a ½" towards the plain end and as such the tailpiece structure must insure that the wrapping does not extend over the second critical point when arranged on the instrument. Fine tuning has been a long standing problem for stringed musical instruments. In the Proelsdorfer U.S. Pat. No. 2,304,597, string tensioning devices placed on the tailpiece for fine tuning the pitch of the strings of violins, guitars and the like, were disclosed, however such pitch adjustment is quite limited in range and designed to offer the tuning of the strings a minor adjustment of pitch after the general tuning is achieved with the tuning pegs on the head of the instrument which first provides the means for raising and adjusting the tension of the strings to pitch from an untensioned condition.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, Fender U.S. Pat. No. 2,741,146, shows and provides a tremolo device which incorporates a novel bridge structure which incorporates the tailpiece and is commonly known to specifically provide the anchoring means for the strings. The bridge plate is also known as the base plate. The base plate upon which the individual bridge elements are adjustably secured has a beveled ridge portion which is secured to the instrument body by six screws for permitting pivotal movement about a fulcrum axis which varies the tension on the strings and produces the desired tremolo effect. The tailpiece is integrated into a spring block descending from the base plate into a cavity within the instrument body. Further, the bridge and the tailpiece both move together as the tremolo device is pivoted. The ball ends and wrapping of the strings are anchored into the recesses in the end of the string block furthermost from the base plate. The strings being threaded through bores individual to each string over two inches in length within the spring block continuing out through the bottom of the base plate and over the bridge elements towards the nut. A singular aspect of the fulcrum tremolo is that the harmonic tuning is upset as the device is pivoted.

Typically, when a fulcrum tremolo pivots about its fulcrum axis, counter springs are utilized to counteract to pull of the strings. Counter springs are usually connected to the body of the instrument at one end and to an attachment means on the bottom of the tremolo at the other end. One of the most troublesome problems with prior art has been maintaining the initial tuning at proper playing pitch. When a musician plays on the sting there is usually some kind of string stretch over time that results in the overall tuning going out of balance. Similarly, the use of the tremolo itself may also introduce string stretch. Further, various factors such as the changes in the humidity of the atmosphere causing the wood in the neck and/or body of the instrument to swell often create subtle distortions in the instrument's geometry which would then in turn disturb the equilibrium point between the tension of the strings and the tension of the counter springs and then as a consequence disturb the initial position. Initial position refers to a specific equilibrium point between the tension of the strings and the tension of the counter springs at the intended tuned pitched condition of the strings. Often the pivot means is subject to wear and the tremolo does not always return to its initial position. For the distance from the bridge elements to the anchoring points, there is an additional amount of unplayable string that is further subject to stretch. Where such demands on the tremolo are minimal this disadvantage is often traded-off for the advantage this extra length contributes as a "looser" feel in playing the instrument.

Improvements to the Fender U.S. Pat. No. 2,741,146 fulcrum tremolo have included using string clamps at the nut and immediately behind the intonation points on each of the bridge elements to limit string stretch to within these two points that define the scale length and separately adopting a novel beveled edge adjustably supported by two screw-like members positioned in the body at the fulcrum point to improve the return to initial position after pivoting the tremolo device (Rose U.S. Pat. No. 4,171,661). In Rose U.S. Pat. No. 4,497,236 a combination of the bridge elements, the tailpiece and fine tuners replaced the "novel bridge structure" incorporating the tailpiece of the Fender device and Rose U.S. Pat. No. 4,171,661 so that within the limited range (typically less than a whole tone) the strings could be re-tuned without unlocking the string clamps at the nut. However, string stretch beyond the range of the fine tuners necessitated a correction that is tedious and time consuming involving unlocking the string clamps, re-tuning the strings, re-adjusting the clamp, and re-tuning all the other strings to re-balance the equilibrium point back to initial position.

Therefore, for stringed musical instruments, as is known to those skilled in the art:

- the second critical point is a clearly defined point on the bridge or individual bridge elements, the adjustment of which relative to the first critical point on the nut defines the length of the string or scale length and is called harmonic tuning; for fulcrum tremolos as originated by Fender U.S. Pat. No. 2,741,146, when pivoted:
- both the bridge portions and the string anchoring means, the tailpiece, simultaneously move about a fulcrum axis;
- there is a tendency for the harmonic tuning to be upset; and various factors can disturb the equilibrium point between the tension of the strings and the tension of the counter springs and as a consequence disturb the initial position; and for those fulcrum tremolos equipped with fine tuners as with Rose U.S. Pat. No. 4,497,236, Storey U.S. Pat. No. 4,472,750 and Fender U.S. Pat. No. 4,724,737:

the fine tuners simultaneously move with the bridge and tailpiece portions about the fulcrum axis when the device is pivoted; and fine tuners are designed to offer the tuning of the strings a minor adjustment of pitch after the general tuning is first achieved by the tuning pegs on the head of the instrument; and for those fulcrum tremolos fitted with string locks at the first and second critical points as in Rose U.S. Pat. No. 4,171,661, string stretch beyond the clamps at the first and second critical points is eliminated offering the most stability of tuning possible for the set of problems associated with string stretch.

In Steinberger U.S. Pat. No. Re. 31,722 stringed musical instruments without tuning pegs placed in the typical fashion on the head of the instrument were commonly known as "headless" stringed musical instruments. The replacement tuning machines were mounted on the body opposite the side where the neck joins the body.

In Takabayashi U.S. Pat. No. 4,608,905 describes an improvement on fulcrum tremolos incorporating "octave tuners", tuners which functioned as the tuning pegs at the head of the instrument and as such integrated the tailpiece function in the tuning means. The bridge portion of the device comprised a "roller" configuration for the second critical point similar to Storey U.S. Pat. No. 4,742,750 and Steinberger U.S. Pat. No. 4,704,936. A cylindrical portion distanced from the bridge portion adjustably secured to the base plate houses a string holder member for one end of the string which is "fitted in such a manner as to be allowed to move freely in the axial direction". The ball end of each string is arranged to be anchored "to the rear end opening of the string holding members" which is adjustably positionable "in the stretching direction of the strings for effecting octave tuning". The string continues through the string holder member sufficient in size to ensure that the wrapping of the ball end does not extend over the second critical point and then passes on over the bridge element towards the nut. In this device the string holder member accomplishes the tailpiece function by anchoring the string at a single point which moves accordingly when the string holder member is displaced to achieve the tuning of the instrument.

Further improvements in the fulcrum tremolo utilized an arrangement with ball bearings at the pivot point within a housing adjustably mounted to the body which not only improved return to initial position after use of the tremolo but also virtually eliminated the wear and tear associated with prior art (McCabe U.S. patent application Ser. No. 07/607,458, Continuation No. 08/027,729, filed Jan. 14, 1993).

Additionally, the replacement of fine tuners with macro-tuners on a fulcrum tremolo (McCabe U.S. patent application Ser. No. 07/607,458, Continuation No. 08/027,729, filed Jan. 14, 1993) provided an intonation module that included a novel integrated one piece bridge-tailpiece structure secured to the base plate where each string anchored within its respective structure passes through a separate lever member and over the bridge element wherein the lever member could be displaced by an adjustment bolt to provide the means to bring and adjust the strings to playing pitch from an untensioned condition circumventing the re-tuning limits imposed by the fine tuner arrangements. These macro-tuners are often part of an intonation module dedicated to each string for use with but not exclusive to "headless" stringed musical instruments, that is, instruments without tuning pegs placed in the typical fashion on the head of the instrument. Certainly, a fulcrum tremolo with macro-tuners could be used with instruments which had tuning pegs without a disadvantage. Further, macro-tuners could be placed on the head or the body of the instrument and if integrated with a string anchoring means could replace the tuning pegs.

Macro-tuners refer to tuners with the capacity to raise and adjust the tension of the strings from an untensioned condition to a proper playing pitch, an as such provide for alternate tunings and compensation for substantial string stretch during the life of the string essentially without additional means.

Often the musician is called upon to play in an ensemble where the other instruments are not tuned to a typical concert pitch. Accordingly, the musician must flatten or sharpen the initial tuning of all the strings on his instrument in order to meet the pitch requirements of other instruments. This re-tuning often disturbs the initial position because the tension of the counter springs has not been readjusted as well. Accordingly, the position of the base plate of the tremolo is either tilting away from or towards the body of the instrument which then can limit the range in which the tremolo can be activated. Steinberger U.S. Pat. No. 4,632,005 and Gunn U.S. Pat. No. 4,955,275 provide for an adjustable counter spring and utilize an adjustment knob that provides a means to vary tension of the counter spring and thereby maintain the equilibrium point between the tension of the counter spring and the tension of the strings on fulcrum tailpiece tremolo, that is, a tremolo device where the bridge elements do not pivot with the anchoring means and, therefore, do not upset the harmonic tuning as such.

The "octave tuners" of the Takabayashi fulcrum tremolo U.S. Pat. No. 4,608,905 anchor the strings at a point on the string holder member spaced on the opposite side from the second critical point on the bridge elements. This arrangement presents serious problems for this tremolo device:

the length of the string subject to stretch beyond scale length, which includes the additional string length as measured from the bridge element to the anchoring point, is increased excessively in general at initial position and far more so when the device is pivoted in view of Rose U.S. Pat. No. 4,171,661 and, tensioning of the strings which holds the ball end of the string securely against the rear end opening of the string holding member is inadequate to keep the ball ends as originally seated in initial position throughout the performance range of the tremolo; such mis-seatings are devastating to the effort to maintaining a tuned instrument.

SUMMARY OF THE INVENTION

Accordingly, an object of this invention is to provide improvements in the mounting means of the bearing and bearing housing arrangement for pivotally supporting the base plate of the fulcrum tremolo that will allow a greater range of installation possibilities.

It is a further object of the invention to provide the intonation modules with macro-tuners integrated with a string anchoring means, known to those skilled in the art as a tailpiece and a separate string holder element that functions to additionally secure the string adjustably to the fulcrum tremolo at an additional point and an adjustment bolt threadedly engaged with the string holder element for slideably positioning the string holder element relative to the second critical point for macro-tuning. The string holder element includes a gripping means in the form of a fork-like element or collet. The string gripping means is disposed within the intonation module structure that grips and secures the string as close as possible to the second critical point I order to limit the length of the string that would otherwise be subject to stretch and provides for an anchoring means that remains stable through the performance range of the tremolo. By threading the adjustment bolt, the string tensioning element is slideably displaced:

- increasing the tension of the associated string to a proper pitched condition and varying the tension of the string thereof so as to provide the macro-tuning function, and
- drawing the fork-like string clamping means of the string tensioning element within the restricted portion of a sleeve-like portion of the intonation module structure, compressing and closing the forks upon the string at the clamping point for transferring the anchoring of the string to an improved anchoring means positioned at the end of the string tensioning element closest to the second critical point.

Yet, another object of the invention is to provide a global tuning mechanism on the fulcrum tremolo that compensates for the problems associated with varying humidity on the instrument as well as other factors that could affect the instrument's geometry. Further, a global tuner would also provide a simple and quick means for the musician to adjust the initial position in order to meet the pitch requirements in varied situations. Further, the global tuner in re-establishing the initial position allows the full range of pivoting the tremolo. Global tuners refer to a means on a fulcrum tremolo with the capacity to adjust the equilibrium point between tension of the counter spring(s) and the tension of the strings in order to compensate for changes in tension requirements on the strings and/or the counter springs. The global tuner preferably employs an adjustment knob for providing continuously variable adjustment of the tension in the strings by varying the relative distance between the spring attachment means on the base plate of the tremolo and the attachment point of the springs to the body.

Another object of the invention is to replace the fine tuner portion on each of the L-shaped arms of the "semi-headless" tuners with macro-tuner mechanisms and, therefore, provide for greater range and easier use. This advancement for adjustably securing each string to a improved clamping means positioned within a sleeve-like portion on one end of a L-shaped arm provides the capacity to tune the string from an tensioned condition to pitched string condition. Each L-shaped arm can pivot and be selectively positioned to a number of pre-set positions relative to the nut or first critical point for raising from an untensioned to a pre-set pitched string condition.

Yet another object of the invention is to provide a fulcrum tremolo having an alternate string anchoring points 247 that are spaced apart from one another. One anchoring point 246 is provided at the bottom of the spring block or spring blade so that the anchoring point 246 is remote from the second critical point. The alternate anchoring point 247 is located adjacent the second critical point so that the length of the string between the second critical point and the string anchor 160 is substantially shorter when the string is anchored at the alternate anchoring point 247. Specifically, the alternate anchoring point 247 is located a distance from the second critical point that is substantially equal to the length of the wrappings on the end of the strings 160.

The various features of novelty which characterize the invention are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE INVENTION

Figure 1:
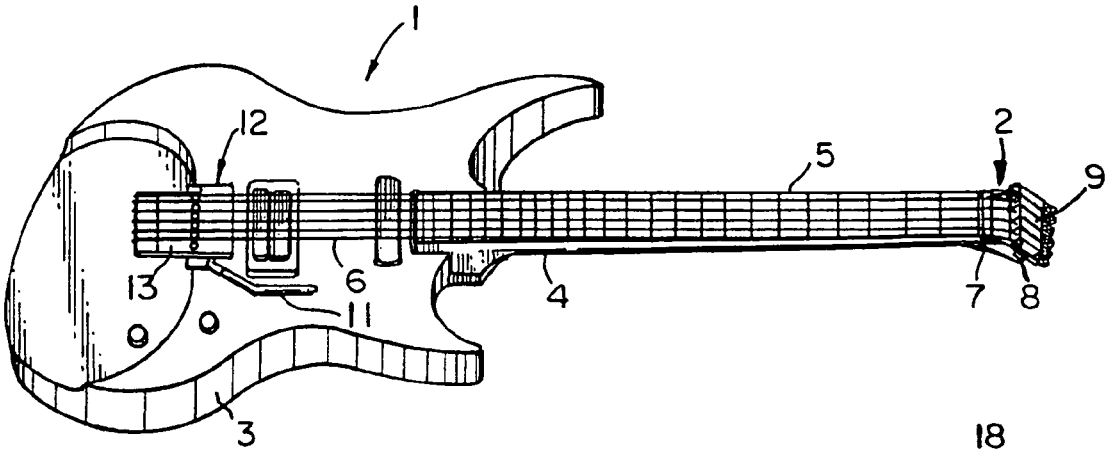
FIG. 1 is a plan view of an electric guitar embodying the present invention.

In FIG. 1, an electric guitar 1 is illustrated comprising a head 2 at one end, a body 3 at the other end, which a neck 4 extending between the head and the body. Six strings 6 extend from head 2 to body 3 over neck 4. Neck 4 forms fret board 5 for guitar 1. At head 2, each of the strings extends over nut 7 forming the first critical point for the strings. Nut 7 is located at the transition of neck 4 to head 2. Each string 6 is secured on the head by anchor 8 and each anchor has a corresponding tuner 9. On the body 3, strings 6 are secured to fulcrum tremolo 12. Fulcrum tremolo 12 has arm 11 for pivoting the tremolo and providing the vibrato effect on the strings. Fulcrum tremolo 12 has six intonation modules 13. The intonation modules present improvements to the macro-tuning invention which incorporates the function of the bridge element and tail-piece in its structure as well as the capacity to adjustably secure the individual strings to the instrument. The intonation modules are movable and thereby provide a means to change the distance between the first and second critical points or the harmonic tuning as such.

The invention is shown for us on electric guitar 1 and it should be understood that the invention could be used on a variety of stringed musical instruments. In body 3 of guitar 1 there are electric pickups. Fulcrum tremolo 12 forms a second critical point for strings 6, sometimes characterized as an intonation point or bridge point.

Figure 2:
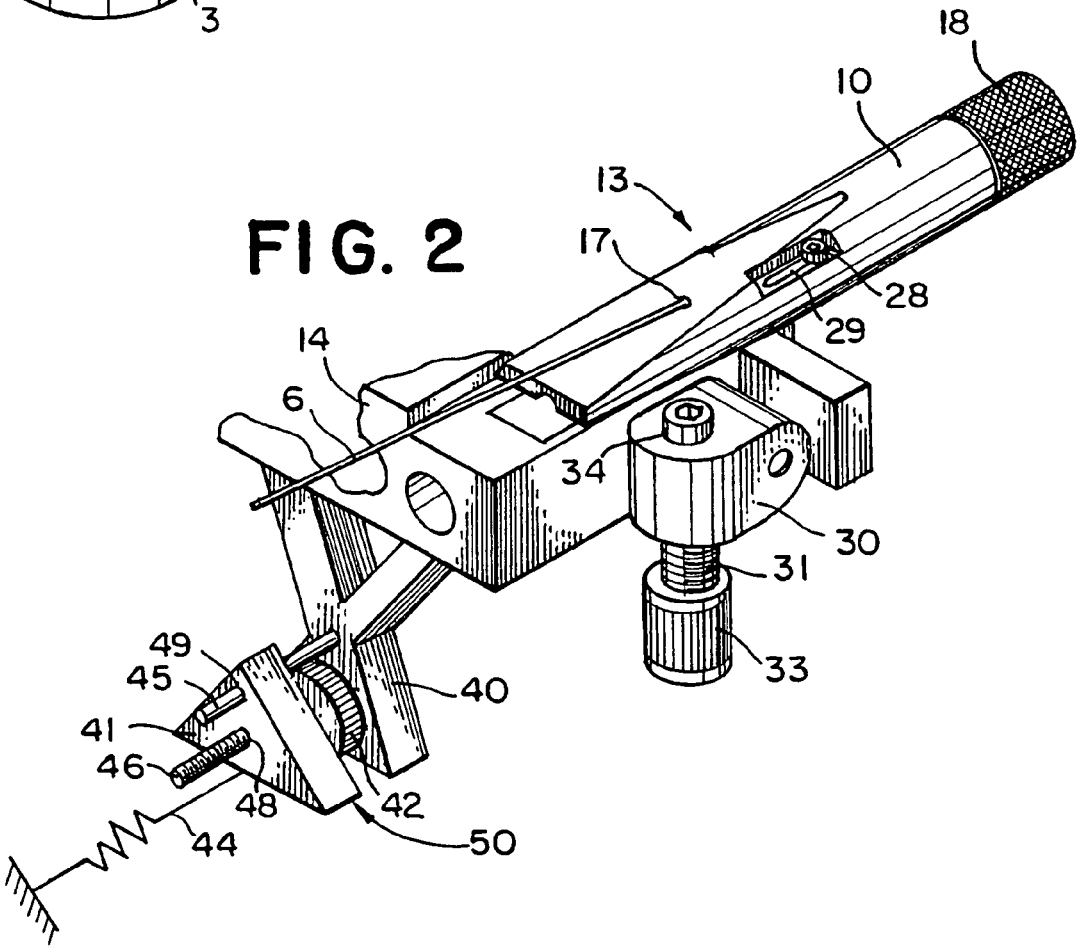
FIG. 2 is a perspective view of the macro-tuners, bearing mounting arrangement and global tuner of the present invention as used in the electric guitar.
Figure 3:
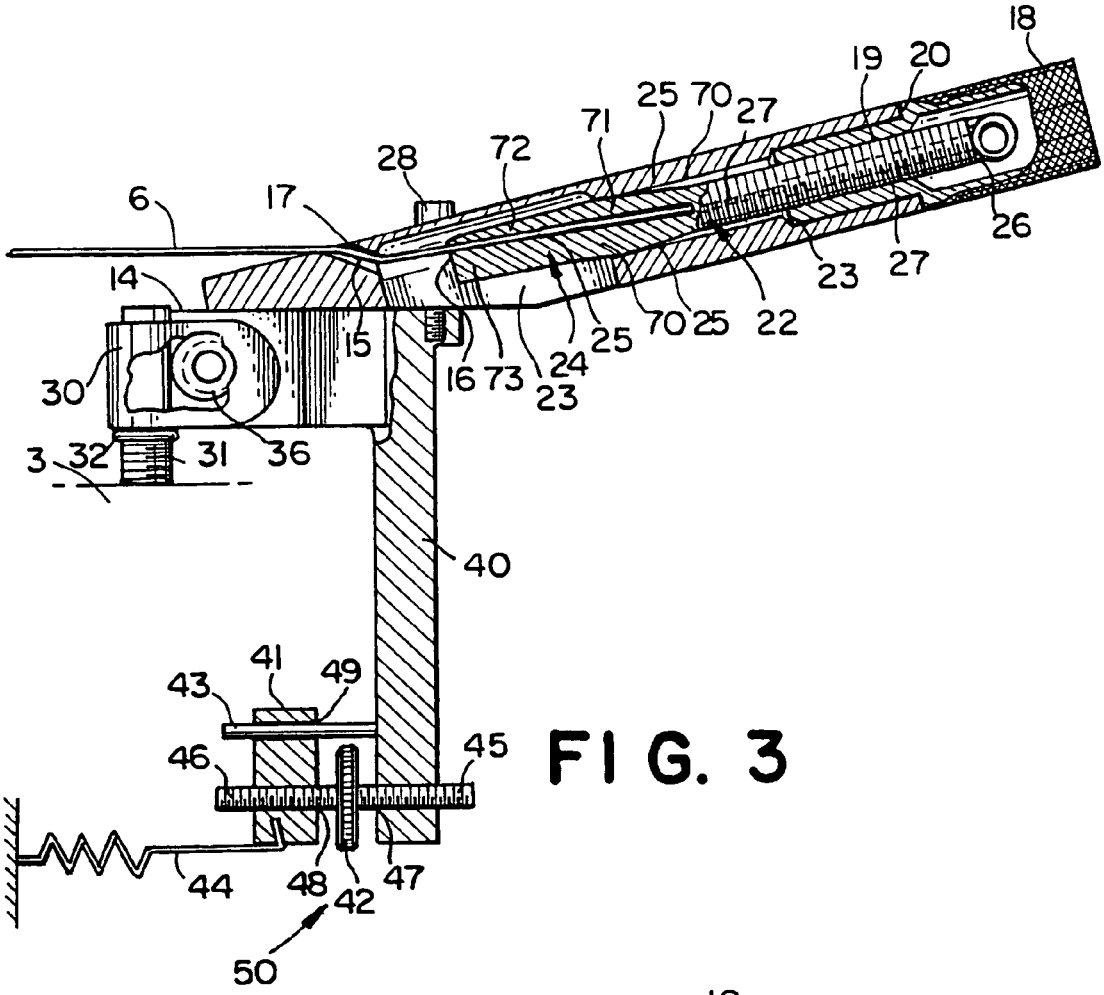
FIG. 3 is a side view cross-section of the tremolo mechanism showing the macro tuners, bearing mounting arrangement and the global tuner.

In the following description, fulcrum tremolo 12 will be described in greater detail. In FIG. 2, fulcrum tremolo 12 is shown on an enlarged scale compared to FIG. 1. FIG. 3 displays fulcrum tremolo 12 of FIG. 2 in a cross-section view. The second critical point is located near the front intonation modules 13. Outwardly from intonation modules 13 on each side of the opposite sides of base plate 14 extending in the direction of the strings there are bearing housings 30. The bearing housing 30 supports base plate 14 pivotally relative to body 3. Global tuner 50 is positioned between spring block 40 extending downwardly form the bottom of base plate 14 and counter springs 44 connected to instrument body 3.

In FIGS. 2 and 3, one of the intonation modules 13 is shown including a shaped barrel-like base 10 with a second critical point formed at string opening 17. Base 10 is adjustably secured to base plate 14 of fulcrum tremolo 12 by machine screws 28 through slots 29. Loosing machine screws 28 permits longitudinal movement of base 10 and associated parts for harmonic tuning of string 6. Adjustment bolt 18 first passes through opening 20 in base 10 and threaded portion 19 of adjustment bolt 18 is engaged with threaded portion 21 of string tensioning element 22 within sleeve-like portion 23 of base 10. String 6 of the musical instrument makes critical contact with base 10 at the string opening 17 to passageway 15 sloping downwardly and rearwardly through base 10 until the string passes into a sleeve-like portion 23. String 6 continues passing through clamping point 16 of string tensioning element 22, through slots 25 between upper fork 72 and lower fork 73 of fork-like string clamping means 24, through string passageway 27 of string tensioning element 22 and is secured at exit 26. Annular flange-like portion 71 of fork-like string clamping means 24 of string tensioning element 22 is in bearing contact with restricted portion 70 of sleeve-like portion 23 of base 10. Threading adjustment bolt 18 slideably displaces the string tensioning element 22 relative to string opening 17 providing an adjustment whereby tension or pull on string 6 is applied and varied for raising and adjusting the strings 6 from an untensioned condition to a pitched string condition: additionally, annular flange-like portion 71 of fork-like string clamping means 24 of string tensioning element 22 is drawn within restricted portion 70 of sleeve-like portion 23, clamping string 6 between upper fork 72 and lower fork 73 at clamping point 16 adjacent to string opening 17.

In FIGS. 2, 3, 4 and 5 outwardly from intonation modules 13 on each side of the opposite sides of base plate 14 shown at the forward end of fulcrum tremolo 12 extending in the direction of the strings, there is bearing housing 30. Bearing housing 30 is adjacent to base plate 14. Housing 30 is adjustably supported relative to body 3 of the instrument by threaded post 31 with annular flange 32. Post 31 is threaded into insert 33 in body 3. By threading post 31 into insert 33, the spacing between body 3 and housing 30 is selectively adjustable. Adjustment of post 31 is effected through an oval opening 34 in the top of housing 30. In housing 30 rearward post 31, there is opening 76 extending transversely of the string direction of guitar 1 containing bearing assembly 35, formed by four side-by-side roller bearings 36. Insert 37 fits into cut-out 38 in the side of base plate 14 with pin 39 with annular flange **39*a* extending outwardly through bearings 36. Annular flange 39*a* on pin 39 spaces the side-by-side roller bearings 36 from base plate 14. Accordingly, by manipulating tremolo arm 11, fulcrum tremolo 12 can be pivoted about pin 39** to achieve the desired tremolo effect.

As can be seen in FIGS. 2 and 3 there is spring attachment means 40 extending downwardly from base plate 14. The preferred embodiment incorporates thumb screws 42 with shaft 45 threadedly engaged with threaded opening 47 in spring block 40 on one side of thumb screw 42 and another shaft 46 with reverse threads in the opposite direction of shaft 45 threadedly engaged with reverse threaded opening 48 in spring holder 41. Counter springs 44 are attached at one end to spring holder 41 and to body 3 on the other end of counter springs 44. Guide pin 43 extending outwardly from spring block 40 towards spring holder 41 passes through guide pin opening 49 in spring holder 41 limiting longitudinal rotational movement of spring holder 41 relative to spring block 40. By threading thumb screw 42 clockwise relative to spring holder means 41, spring holder 41 moves closer to spring block 40 increasing the tension of the counter springs 44 and by threading thumb screw 42 counter-clockwise relative to spring holder means 41, spring holder 41 moves away from spring block 40 decreasing the tension of the counter springs 44 providing the means to adjust the equilibrium point and globally tune fulcrum tremolo 12.

Figure 6:
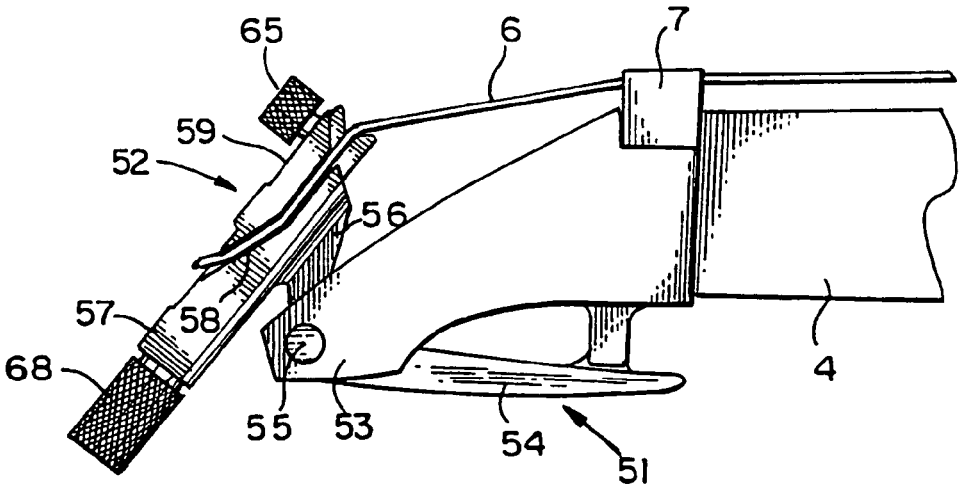
FIG. 6 is a side view of the "semi-headless tuners" with two macro-tuning means.
Figure 7:
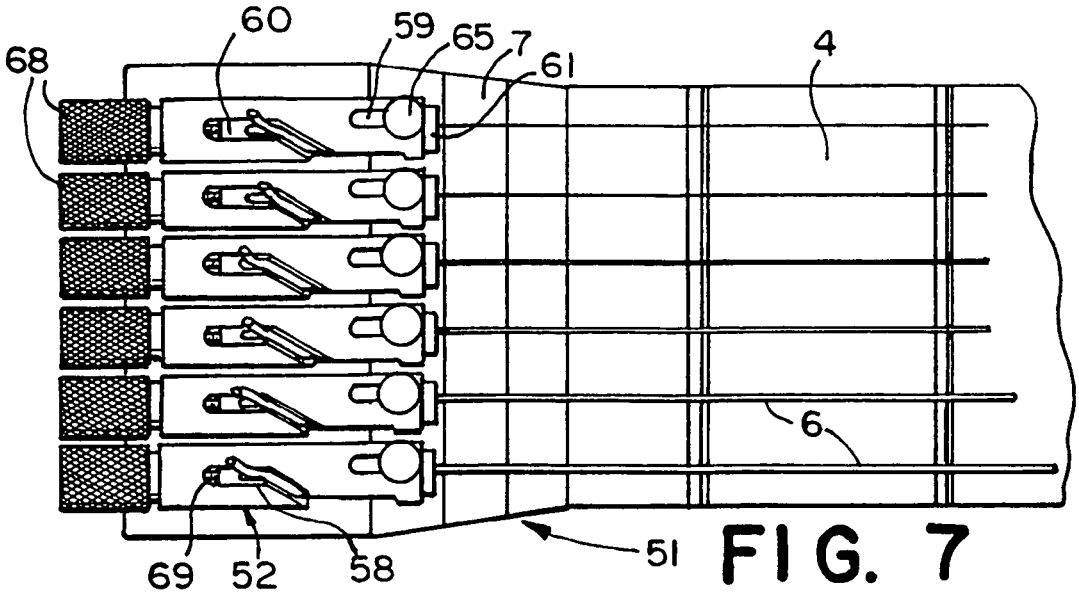
FIG. 7 is a top view of the "semi-headless tuners" attached to the neck of the guitar.

FIG. 6 displays an improved "semi-headless" tuner arrangement for stringed musical instruments. In FIG. 7, the end of neck 4 is shown with strings 6 each of a different size. The strings 6 pass over nut 7 and each string is secured by string tensioning tuning device 51, a "semi-headless tuner". There is a separate macro-tuning device 52 for each string.

The device, as set forth in FIGS. 6 & 7 includes bracket 53 secured to and projecting from the end of neck 4. L-shaped lever 54 is pivotally connected by pin 55 as shown in FIG. 6. The other or second arm 56 of lever 54 extends from pivot pin 44 toward the end of neck 4.

At the end of second arm 56 there is sleeve-like portion 57. String slot 58 extends longitudinally along sleeve-like portion 57 continuing disposed at an angle towards the top of the sleeve. Slot 59 at the free end of the sleeve extends towards the connected end of second arm 56.

Adjacent the free end and within sleeve-like portion 57, there is string clamping means 60 with fork-like portion 61 with upper fork 62 and lower fork 63 and at the opposite end there is threaded opening 64. Thumb screw 65 passes through slot 59 in sleeve-like portion 57 and through unthreaded opening 66 in upper fork 62 and is threadedly engaged with threaded opening 67 in lower fork 63. String 6 is arranged through slotted opening 58 and into slotted opening 75 between upper fork 62 and lower fork 63. Threading thumb screw 65 clamps the upper fork 62 and lower fork 63 on string 6, securing string 6 to string clamping means 60.

Adjustment bolt 68 is adjustably mounted within sleeve-like portion 57 opposite the free end. Threaded portion 69 of adjustment bolt 68 is threadedly engaged with threaded opening 64 adjustably securing string clamping means 60 to macro-tuner 52. By threading adjustment bolt 68 the clamping means can be displaced relative to nut 7 wherein the tension on string 6 can be raised and varied whereby the macro tuning can be achieved.

Figure 8:
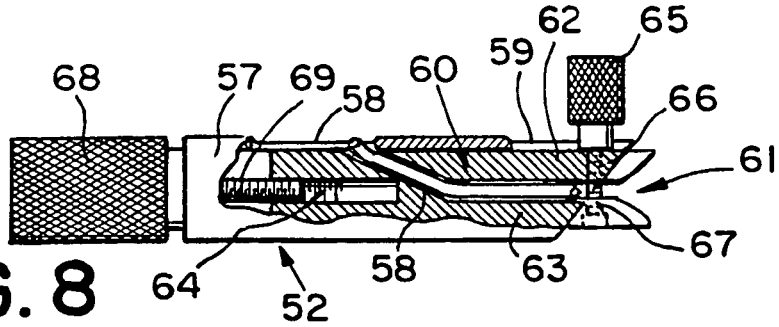
FIG. 8 is a cross-section view of the side of a macro-tuning mechanism.

Referring to FIG. 8, a single macro-tuning device is shown in which string 6 passes through slots 58 of sleeve-like portion 57 and is arranged between upper fork 62 and lower fork 63 of fork-like portion 61 of string clamping means 60 and clamped and secured by thumb screw 65 wherein threaded portion 69 of adjustment bolt 68 is threadedly engaged with threaded opening 64 of string clamping means 60. By threading adjustment bolt 68 the position of string clamping means 60 relative to the anchoring means at the opposite end string 6 is increased and varied whereby tension or pull on string 6 is applied and varied for raising and adjusting the strings 6 from an untensioned condition to a pitched string condition.

Figure 9:
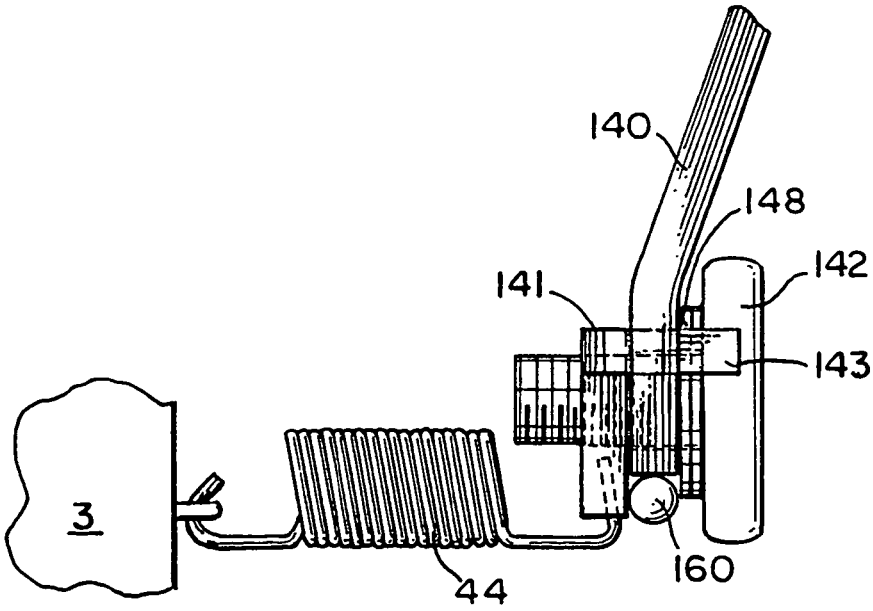
FIG. 9 is an enlarged fragmentary side view of an alternate embodiment of a global tuning mechanism.
Figure 10:
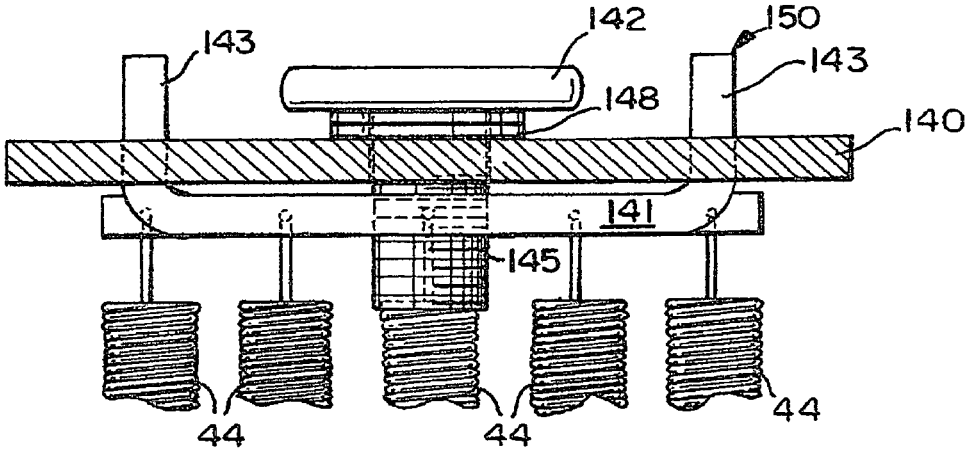
FIG. 10 is a plan view partially in section of the global tuning mechanism illustrated in FIG. 9.

Referring now to FIGS. 9-10, an alternate embodiment of a global tuner 150 is illustrated. The global tuner 150 is shown in connection with a fulcrum tremolo having an integral base plate and spring blade 140 similar to the fulcrum tremolo shown in FIG. 11 and described below. Alternatively, the global tuner may be incorporated into a fulcrum tremolo having a separate base plate and spring block or spring blade.

The global tuner 150 includes a spring blade 140 connected to the base 14 of the tremolo, and extending into a cavity in the body 3 of the musical instrument. A plurality of counter springs 44 bias the tremolo against the tension in the strings. The springs are connected at one end to the body 3 of the instrument. The second end of each spring is connected to a spring holder 141. The spring holder 141 has a plurality of sockets, each of which receives the second of one of the springs. An internally threaded aperture extends through the thickness of the spring holder, and is aligned with an aperture through the thickness of the spring blade 140. A thumbscrew 142 extends through the aligned apertures in the spring blade 140 and the spring holder 141, threadedly engaging the spring holder. Preferably a low friction element, such as a teflon washer 148 is disposed about the shaft 145 of the thumbscrew 142, between the head of the thumbscrew and the spring blade 140. Additionally, preferably, the spring holder 141 includes a pair of alignment tabs 143 integral with the body of the spring holder. The alignment tabs 143 mate with cooperating apertures in the lower end of the spring blade 140 to prevent vertical and lateral relative movement between the spring blade and the spring holder, while allowing longitudinal relative movement between the spring blade and the spring holder. Additionally, the lowermost edge of the spring blade 140 includes a plurality of notches or recesses for receiving the anchoring ball 160 at the end of the instrument strings if desired. If a plurality of macrotuners is utilized as described above, then the anchoring balls are engaged by the macrotuners. As in the previous embodiment, by turning the thumbscrew 165, the extension of the springs 144 is varied, which in turn varies the bias in the springs 144, thereby globally tuning all of the strings simultaneously.

Figure 4:
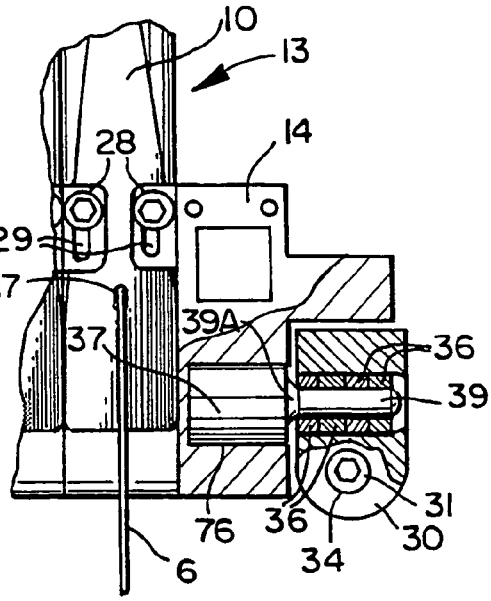
FIG. 4 is a top view cross-section of the ball bearings, the housing mounting means.
Figure 5:
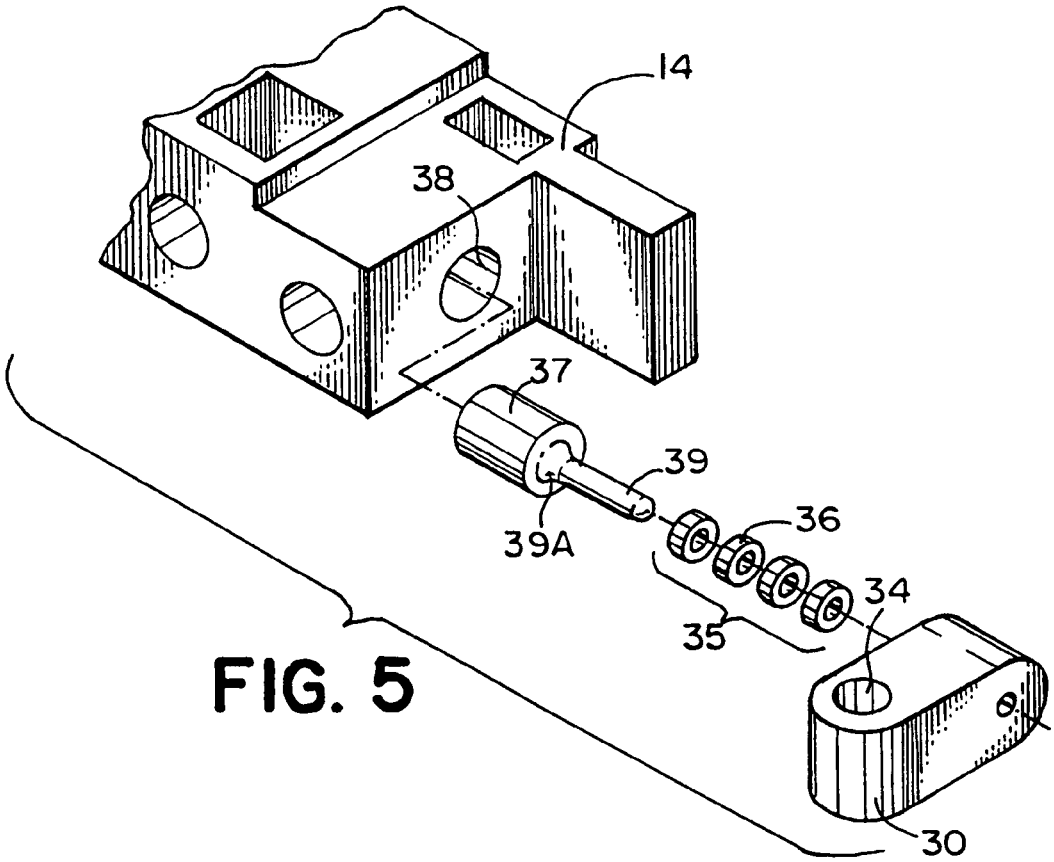
FIG. 5 is an exploded perspective view of the bearing ball bearings, the housing mounting means.
Figure 11:
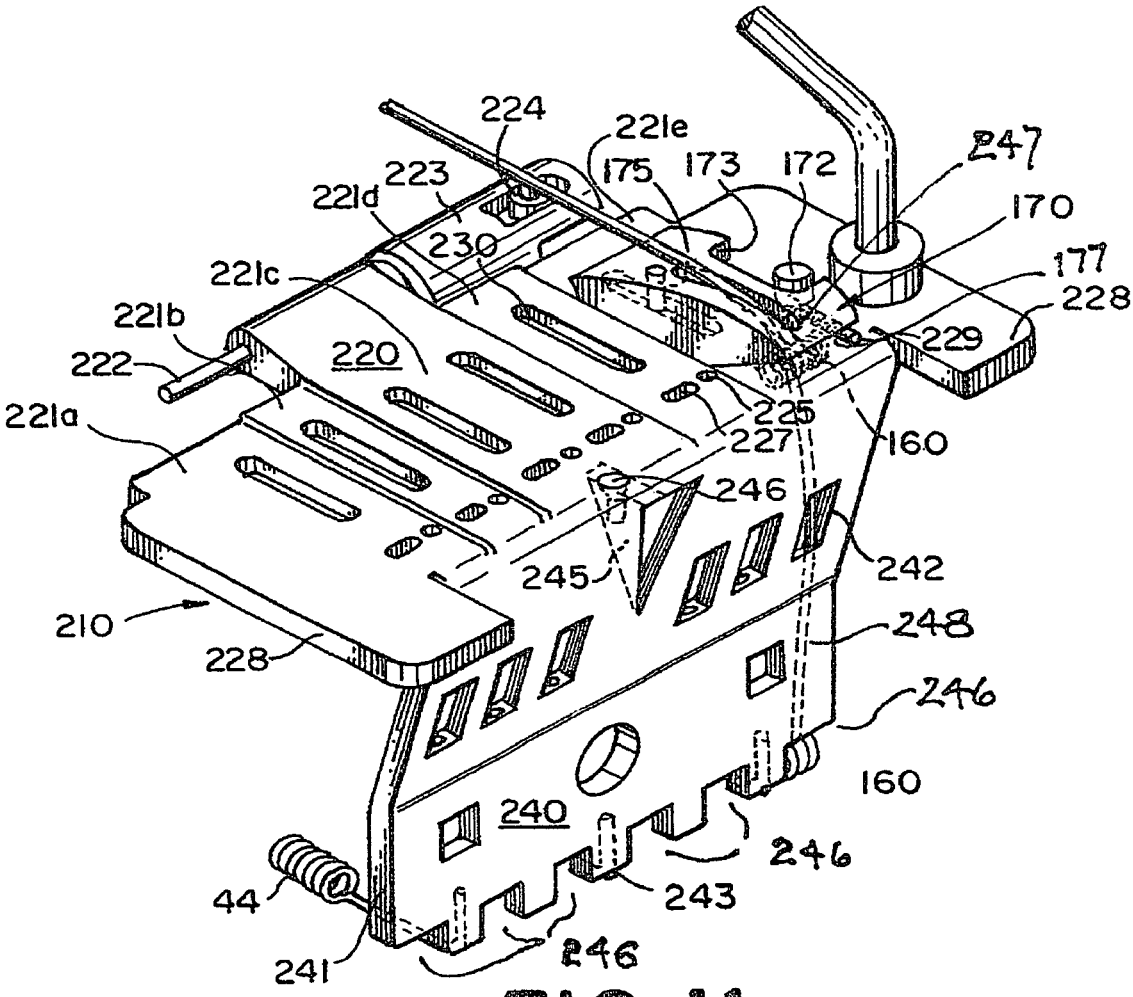
FIG. 11 is a perspective view of an alternate embodiment of a fulcrum tremolo according to the present invention, base plate for a fulcrum tremolo

Referring now to FIG. 11, an alternate fulcrum tremolo 210 having a base plate 220 that incorporates an integral spring blade 240 is illustrated. The base plate 220 is generally planar having a horizontal bore through the width of the base plate. A rod 222 extends through the horizontal bore and is supported at both ends by ring bearings 223 located within two bearing housing. For clarity, only one bearing housing is illustrated in FIG. 11. The rod 222 forms the fulcrum axis for the fulcrum arm, so that the fulcrum tremolo is pivotable about the rod 222. An adjustment screw 224 threadedly engages the bearing housing 223. The adjustment screw 224 vertically displaces the fulcrum axis and the base plate relative to the body of the musical instrument. The adjustment screw 224 is substantially aligned with the pivot axis so that the pivot axis intersects the vertical axis of the adjustment screw. Alternatively, as shown in FIGS. 3 and 4, the pivot axis may be rearwardly spaced from the adjustment screw.

The base plate 220 includes a plurality of sockets 225 for connecting intonation modules to the base plate. In the present instance, the sockets 225 are threaded so that a screw can be used to connect intonation modules to the base plate. The present base plate is configured to receive six intonation modules. However, the base plate can be configured to receive a different number of intonation modules for different application. For clarity, in FIG. 11 only, a single intonation module 170 is illustrated. The intonation module in FIG. 11 simply comprises a bridge element. Alternatively, the intonation module can incorporate a macrotuner as discussed above and illustrated in FIG. 8.

The intonation module 170 is connected to the base plate 220 by an attachment screw 172 that threadedly engages a threaded socket 225 in the base plate. An alignment pin 175 projects from the button of the intonation module 170 and engages a longitudinally elongated slot 230 in the base plate. The base plate includes similar slots and threaded sockets for attaching five similar intonation modules.

The intonation module 170 includes a longitudinally elongated slot 173 for receiving the attachment screw 172. The elongated slot 173 allows longitudinal adjustment of the intonation module 170, which adjusts the position of the bridge element that forms the second critical point for the corresponding string. Accordingly, the second critical point can be moved toward or away from the first critical point by loosening the attachment screw 172 and moving the intonation module. The ends of the slot 173 in the intonation module 170 form forward and rearward stops limiting the longitudinal movement of the intonation module. The sides of the slot 230 that receives the alignment pin 175 form side stops limiting lateral movement of the intonation module. In addition, preferably the base plate includes an adjustment screw 229 for adjusting the longitudinal position of the intonation module.

The base plate is operable with intonation modules that include a macrotuner as described above. Such intonation modules provide an anchor for anchoring the anchoring ball or string anchor 160 that is at the end of the string. Alternatively, an intonation module that provides two alternate string anchoring points can be utilized. Such an intonation module 170 is illustrated in FIG. 11.

The spring blade 240 provides anchoring points 246 for the string anchor. String anchor 160 is seated in one of the notches 246 at the bottom of spring blade 240. The string extends upwardly through an elongated cylindrical passageway 248 both illustrated in phantom in FIG. 11 in lower portion of 241 of the spring blade 240. The string then passes through an opening in the spring blade referred to as string passageway 242. From the string passageway 242 the string passes through string hole 227 in the base plate 220. The string then passes through the intonation module 170 and over the second critical point.

The intonation module 170 is configured so that the distance from the rearward outer surface 177 of the intonation module to the second critical point is approximately equal to the length of the wrapping of the string, the length of the wrapping being slightly less than the distance between the second critical point and the rearward surface of the intonation module. In this way, the wrapping of the string does not engage the second critical point. Further, the length of the string rearward of the second critical point is substantially inextensible.

Accordingly, the intonation module provides alternate anchoring points. Connecting the strings so that the string anchors 160 are anchored at the bottom of the spring blade 240 provides for an extended length of string rearward of the critical point that is subject to stretch so that the fulcrum tremolo creates a "looser" feel for the user. Alternatively, the strings can be anchored to the rearward end of the intonation module.

The base plate 220 may be substantially planar. However, in the present instance the base plate is multi-tiered, having five tiers for receiving the intonation modules. The first tier 221*a* receives the sixth intonation module. The next tier 221*b* is approximately 0.020 inch higher than the first tier 221*a*, and it receives the fifth intonation module. The third tier 221*c* is approximately 0.020 inch higher than the second tier 221*b*, and it is approximately twice as wide as the second tier, so that the third tier is sized to receive the third and fourth intonation modules. The fourth tier 221*d* is approximately 0.020 inch lower than the third tier 221*c*, so that the fourth tier is substantially the same height as the second tier 221*b*. The fourth tier 221*d* receives the second intonation module. The fifth tier 221*e* is approximately 0.020 inch lower than the fourth tier 221*d*, so that the fifth tier is substantially the same height as the first tier 221*a*. The fifth tier receives the first intonation module, which is illustrated in FIG. 11.

As noted above, the spring blade 240 is integrally formed with the base plate 220. The spring blade 240 projects transverse vertically downwardly from the base plate 220. A reinforcing rib 245 extends transverse the spring blade 240 and the base plate 220, connected to the spring blade and the base plate. In the present instance the reinforcement rib 245 is integral with the spring blade 240, and a fastener 246, such as a screw, connects the reinforcement rib to the base plate 220. The lower portion of the spring blade 241 forms an angle with the upper portion of the spring blade 240. At least one spring socket 243 is formed into the lower portion of the spring blade 241. The spring socket 243 is a generally cylindrical cavity for receiving the end of a spring that is connected to the body of the instrument. The spring biases the tremolo against the tension in the strings as discussed above. Alternatively, a global tuner similar in construction to the global tuner 50 described above can be utilized. Such a global tuner is disposed between the spring blade 240 and the spring to alter the bias that the spring applies to the spring blade.

The base plate 220 and spring blade 240 are integrally formed from a single piece of material as follows. A single piece of plate material, such as 7⁄64" plate steel is provided. The plate is stamped to form the multiple tiers 221*a-e*. The forward edge of the plate is folded over on itself to form a ridge across the central portion of the width of the plate that is at least twice the thickness of the plate material. A plurality of fasteners, such as screws rigidly connect the two layers of the ridge to one another. The bore of the fulcrum axis is then formed in the ridge, preferably by drilling the bore laterally through the width of the ridge.

Two parallel spaced-apart slots are formed in the plate. The slots extend forwardly from the rearward edge of the plate and terminate rearwardly from the forward edge of plate. The portion of the plate between the slots forms the spring blade 240. The portion of the plate forward of the terminated slots forms the base plate 220. The reinforcing rib 245 is cut from the portion of the plate that forms the spring blade 240. One end of the reinforcing rib is left uncut, so that the reinforcement rib is integral with the spring blade 240.

The spring blade is formed by bending the portion of the plate between the two terminated slots vertically downwardly, so that the spring blade is transverse the base plate 220, projecting downwardly and forwardly toward the forward edge of the base plate. The width of the spring blade 240 is narrower than the width of the base plate 220 so that bending the plate to form the transverse spring blade forms two spaced-apart tabs 228 extending rearwardly from the base plate, integral with the base plate, and straddling the spring blade. The lower portion of the spring blade 241 is then bent transverse the upper portion of the spring blade, so that the lower portion 241 projects downwardly as shown in FIG. 11, so that string passageway 242 aligns with the string holes 227 in the base plate 220.

The reinforcement rib 245 is bent about the line forming the uncut edge of the reinforcement rib. The rib 245 is then attached to the lower surface of the base plate. In the present instance, the rib 245 is connected to the base plate 220 by a fastener, such as a screw 246, extending through the base plate and into an internally threaded portion in the rib.

In this way, the tremolo base plate 220 is integrally formed with the spring blade 240 from a single piece of material, so that a single unitary component connects the tremolo to the spring that biases the tremolo against the tension in the instrument strings.

While specific embodiments of the invention have been shown and described in detail to illustrate the application of the inventive principles, it will be understood that the invention may be embodied otherwise without departing from such principles.

I claim:

1. A tuning apparatus for a stringed musical instrument comprising:

a body and a neck extending outwardly from said body, a plurality of strings extending from the body to the neck, a first critical point for each of said strings on the neck, a second critical point for each of the strings on the body, the apparatus further comprising:

a base comprising a forward end and a rearward end and upper portion and a lower portion, comprising:

a bridge element connected to the base, the bridge element located closer to the forward end forming a second critical point; and a first portion connected to the base and located in the rearward end forming an alternate string anchoring point closer to the lower portion than the second critical point, and wherein the lower portion being attached to the upper portion and the lower portion comprises:

a second portion that is transverse to the alternate string anchoring point;

and a first string anchoring point.

2. The apparatus of claim 1, wherein the apparatus further comprises:

a fulcrum tremolo.

3. The apparatus of claim 1, wherein the upper portion further comprises:

a string opening located between the first anchoring point and the second critical point, and wherein the second portion further comprises:

a member with a string passageway connected to the second anchoring point having an axis, the axis being aligned to the string opening in the upper portion.

4. The apparatus of claim 3, wherein the apparatus further comprises:

a fulcrum tremolo.

5. An apparatus comprising:

a bridge element and a tailpiece element connected to the bridge element, the tailpiece comprising:

a first portion having a rearward surface having a string anchoring point comprising a recess formed to receive a string anchor therein and a second portion that is transverse to the first portion comprising:

a first end that connects the second portion to the first portion;

a second end, the second end having an alternate string anchoring point comprising a recess formed to receive a string anchor and an elongated passageway that extends through the second portion from the first end to the second end, along a longitudinal axis of the second portion, forming at least one opening on each end.

6. An apparatus comprising:

a body;

a fulcrum tremolo;

a biasing element comprising a first end connected to the fulcrum tremolo and a second end connected to the body; and at least one biasing element holder; and a singular apparatus directly connected to the biasing element the singular apparatus comprising:

a thumbwheel portion operable to position the at least one biasing element holder, wherein rotation of the thumbwheel portion alters the bias applied by the biasing element.

7. The apparatus of claim 6, wherein the singular apparatus further comprises:

a U-shaped spring.

8. An apparatus for a stringed musical instrument comprising:

a body; and a fulcrum tremolo, the apparatus comprising:

a biasing element, the biasing element comprising at least one spring comprising a first end and a second end, the first end and the second end positioned opposite from each other on the at least one spring, the at least one spring positioned between the fulcrum tremolo and the body;

a spring holder connected to the biasing element;

a singular apparatus in direct contact with the at least one spring, the singular apparatus comprising a thumbwheel and a threaded elongated portion, the threaded elongated portion threadedly connected to the singular apparatus and the threaded elongated portion threadedly connected to the singular apparatus, wherein rotation of the thumbwheel alters the bias applied by the at least one spring.

9. The apparatus of cliam 8, wherein the singular apparatus further comprises:

a secondary spring holder being threadedly engaged with the threaded elongated portion, and wherein the fulcrum tremolo being positioned between the thumbwheel and the secondary spring holder.

10. The apparatus of cliam 8, wherein the spring holder being positioned between the thumbwheel and the biasing element.

11. The apparatus of claim 10, further comprising a secondary spring holder connected to the biasing element, wherein the thumbwheel further comprises a second elongated threaded portion, wherein the fulcrum tremolo further comprises a threaded opening, and wherein the thumbwheel is positioned between the secondary spring holder and the threaded opening.

12. A fulcrum tremolo with a forward end and a rearward end, the fulcrum tremolo comprising:

a base plate comprising a string hole, a spring holder that is transverse to the base plate comprising:

a tailpiece, the tailpiece comprising a string anchoring point; and a string passageway having an axis wherein a longitudinal axis of the string passageway aligns with the string hole;

an intonation module attached to the spring holder comprising:

a bridge element connected to the base, the bridge element located closer to the forward end than the rearward end and wherein the rearward portion forms an alternate tailpiece, the alternate tailpiece comprising an alternate string anchoring point; and wherein the alternate string anchoring point is located a distance from the second critical point so that a string is rendered essentially inextensible between the alternate string anchoring point and the second critical point.

13. The fulcrum tremolo of claim 12, wherein the intonation module further comprises:

a macro tuner.

14. A tremolo for a stringed musical instrument comprising: at least one bridge element; and a unitary component that is a single piece of bent material comprising:

a base plate being approximately planar, comprising:

a forward edge, a portion of the forward edge being a pivot and forming a pivot axis, and an end opposite of the forward edge;

the opposite end of the forward edge of the base plate comprising:

a bend in the unitary component;

a transverse portion comprising:

at least one spring socket to receive an end of at least one biasing element; and wherein the bend transitions the base plate to the transverse portion, and wherein the bend and the transverse portion are approximately parallel to the pivot axis, and wherein the unitary component is connected to the at least one bridge element.

15. The tremolo of claim 14, wherein the transverse portion further comprises:

at least one string socket.

16. A fulcrum tremolo for a stringed musical instrument comprising:

a unitary component that is a single piece of bent material comprising:

a base plate being approximately planar, comprising:

a forward edge, a portion of the forward edge being a pivot and forming a pivot axis, and an end opposite of the forward edge;

a first bend in the unitary component at an opposite end of the forward edge of the base plate;

and a transverse portion comprising:

at least one spring socket to receive an end of at least one biasing element, wherein the first bend transitions the base plate to the transverse portion, and wherein the first bend and the transverse portion are approximately parallel to the pivot axis, at least one bridge element connected to the unitary component.

17. The fulcrum tremolo of claim 16, wherein the first bend further comprises:

a reinforcement.

18. The fulcrum tremolo of claim 16, wherein the transverse portion further comprises:

at least one string socket to receive an end of a string.

19. The fulcrum tremolo of claim 18, wherein the base plate further comprises at least one string hole, and wherein the transverse portion further comprises:

an upper portion;

a lower portion comprising at least one string passageway, each of the at least one string passageway is aligned with at least one of the least one string hole in the base plate; and at least one second bend that transitions from the upper portion to the lower portion, wherein the lower portion is approximately parallel to the pivot axis.

20. The fulcrum tremolo of claim 18, wherein the base plate further comprises:

at least one tier for displacing the at least one bridge element from the base plate.

21. The fulcrum tremolo of claim 16, wherein the transverse portion further comprises:

the at least one string socket.

22. The fulcrum tremolo of claim 16, wherein the pivot further comprises: a pivot having a knife edge.

23. The fulcrum tremolo of claim 16, wherein the pivot further comprises: a pivot having a beveled edge.

24. The fulcrum tremolo of claim 16, wherein the pivot further comprises:

at least a portion of a ball bearing surface.

25. The fulcrum tremolo of claim 16, wherein the pivot further comprises: at least a portion of a ball bearing surface; and at least a portion of a shaft.

26. A fulcrum tremolo for a stringed musical instrument comprising:

at least one bridge element; and a unitary component that is a single piece of bent plate material having a substantial uniform thickness comprising:

a base plate being approximately planar, comprising:

a pivot forming a pivot axis;

at least one bend in the base plate;

at least one additional portion formed to receive at least a portion of at least one bearing assembly, wherein the at least one bend and the at least one additional portion have an axis approximately parallel to the pivot axis, and wherein the unitary component is connected to the at least one bridge element.

27. A fulcrum tremolo for a stringed musical instrument comprising at least one bridge element; and a base plate being approximately planar, comprising:

a forward edge, and;

at least one additional portion formed to receive at least a portion of at least one bearing assembly;

the at least one bearing assembly, comprising:

at least a portion of a shaft, at least one housing, at least a portion of a ball bearing surface, and at least one annular flange wherein the at least one annular flange spaces the at least a portion of at least one bearing assembly way from the base plate.

28. A bridge-tailpiece for a stringed musical instrument comprising:

a fulcrum tremolo, the fulcrum tremolo further comprising:

an element to receive at least one musical instrument string, the element comprising:

a first string anchoring point for each string; and an alternate string anchoring point for each string; and an intonation module with a forward portion and a rearward portion;

the intonation module comprising:

a base;

a bridge element connected to the base, the bridge element located closer to the forward end forming a second critical point; and wherein the rearward portion forms a string anchoring point closer to the base than the second critical point; and wherein the string anchoring point is located a critical distance from the second critical point operable to render a string as approximately inextensible between the anchoring point and the second critical point;

and a biasing element comprising a first end connected to the fulcrum tremolo and a second end connected to the body; and at least one biasing element holder; and a singular apparatus connected to the fulcrum tremolo, the singular apparatus comprising:

a thumbwheel portion operable to position the at least one biasing element holder, wherein rotation of the thumbwheel portion adjusts the equilibrium point between the tension of the strings and the tension of the biasing element to adjust initial position;

and an unitary component that is a single piece of bent material comprising:

a base plate being approximately planar, comprising:

a forward edge, a portion of the forward edge being a pivot and forming a pivot axis, and an end opposite of the forward edge;

the opposite end of the forward edge of the base plate comprising:

a first bend in the unitary component;

and a transverse portion comprising:

at least one spring socket to receive an end of at least one biasing element, wherein the first bend transitions the base plate to the transverse portion, and wherein the first bend and the transverse portion are approximately parallel to the pivot axis;

the unitary component further comprising:

at least one additional portion formed to receive at least a portion of at least one bearing assembly, wherein the at least one bend and the at least one additional portion have an axis approximately parallel to the pivot axis, and wherein the unitary component is connected to the at least one bridge element.

29. A fulcrum tremolo for a stringed musical instrument comprising a body and a neck, a plurality of strings extending from the body to the neck, a nut for supporting the strings on the neck forming a first critical point for each string wherein the fulcrum tremolo comprises a macro tuner:

the macrotuner having a forward end closer the nut and a rearward end further the nut, the macro tuner comprising:

base;

a bridge element connected to the base located closer the forward end forming a second critical point;

an elongated portion slideably connected to the base;

a string holder element, the string holder further comprises a tailpiece, and an adjustment screw connected to the base operable to position the elongated portion;

the elongated member, the adjustment screw and the string holder located on the opposite side of the second critical point from the first critical point, wherein threading the adjustment screw is operable to position the string holder element to change tension of strings.

30. The macro tuner of claim 29, wherein the base further comprises a restricted portion, the elongated member further comprises:

a clamping portion closer to the second critical point;

a sting passageway; and an annular flange, and wherein the annular flange is in varying contact with the restricted portion;

wherein threading the adjustment screw to tension a string is operable to clamp the string between the second critical point and the tailpiece.

31. A macro tuner having a front end and a rearward end, the macro tuner comprising:

a bridge element located closer the front end forming an intonation point;

an elongated member slideably connected to the macro tuner, the elongated member located on the opposite side of the bridge element from the front end, an adjustment screw connected to the macro tuner operable to position the elongated member; the adjustment screw located on the opposite side of the bridge element from the front end, a string holder element connected to the elongated member located on the opposite side of the bridge element from the front end, the strong holder element comprising a tailpiece comprising a string anchoring point, wherein threading the adjustment screw is operable to position the string holder element to tension a string, and wherein the macro tuner is located on an apparatus consisting of a fulcrum tremolo.

* * * * *

US007470841C1

(12) EX PARTE REEXAMINATION CERTIFICATE (8945th)

United States Patent
McCabe

(10) Number: US 7,470,841 C1
(45) Certificate Issued: Apr. 3, 2012

(54) TUNING APPARATUS FOR STRINGED INSTRUMENT

(76) Inventor: Geoffrey L McCabe, Topoganga, CA (US)

Reexamination Request:
No. 90/011,374, Dec. 7, 2010

Reexamination Certificate for:

| | |
|---|---|
| Patent No.: | **7,470,841** |
| Issued: | **Dec. 30, 2008** |
| Appl. No.: | **09/830,279** |
| Filed: | **Oct. 23, 2001** |

(51) Int. Cl.
*G10D 13/02* (2006.01)

(52) U.S. Cl. ..... 84/312 R
(58) Field of Classification Search ..... 84/312 R
See application file for complete search history.

(56) References Cited

To view the complete listing of prior art documents cited during the proceeding for Reexamination Control Number 90/011,374, please refer to the USPTO's public Patent Application Information Retrieval (PAIR) system under the Display References tab.

*Primary Examiner*—Jason Proctor

(57) ABSTRACT

A stringed musical instrument is provided with a tremolo with a unitary base plate formed from a single folded or bent plate including a spring attachment means portion so that the tremolo is connected directly to the biasing springs; such a folded construction also includes multiple tiers stamped into the base plate portion for displacing the height of the second critical point on the intonation modules relative to the body of the instrument; the spring attachment means portion is fashioned such that the openings for anchoring the ends of the strings are aligned to openings in the base plate for threading the strings through the intonation modules. Additionally, intonation modules include alternative means for anchoring the strings located a critical distance from the second critical point essentially equal to the length of the anchoring portion or the reinforcement windings of the strings but not sufficient in length to engage the second critical point so as to render that portion of the string between the second critical point and the string anchor substantially inextensible.

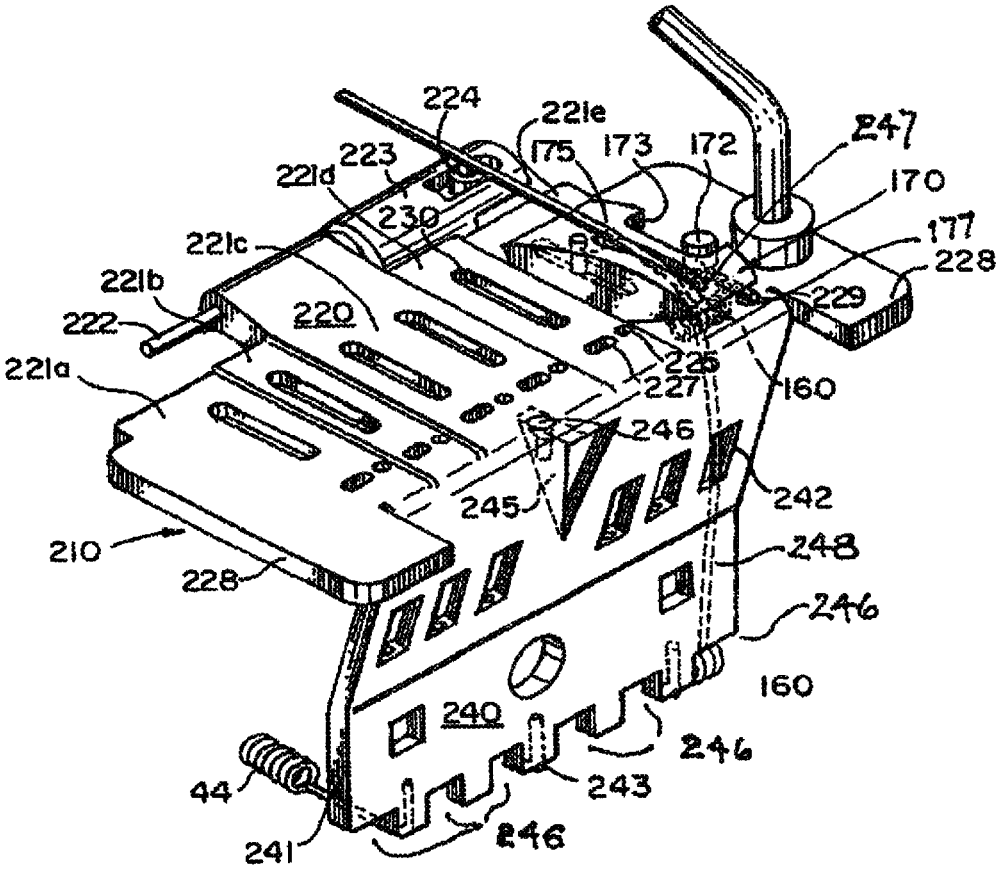

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 29-31 is confirmed.

Claims 1-28 were not reexamined.

* * * * *